US007716865B2

(12) United States Patent
Daniel et al.

(10) Patent No.: US 7,716,865 B2
(45) Date of Patent: May 18, 2010

(54) SYSTEMS AND METHODS FOR PROVIDING A HAND GUARD AND ACCESSORY MOUNTING DEVICE FOR A FIREARM

(75) Inventors: Marvin C. Daniel, Savannah, GA (US); Ashley A. Burnsed, Jr., Port Wentworth, GA (US)

(73) Assignee: Daniel Defense, Inc., Black Creek, GA (US)

( * ) Notice: Subject to any disclaimer, the term of this patent is extended or adjusted under 35 U.S.C. 154(b) by 15 days.

(21) Appl. No.: 11/753,494

(22) Filed: May 24, 2007

(65) Prior Publication Data

US 2008/0092422 A1 Apr. 24, 2008

Related U.S. Application Data

(60) Provisional application No. 60/808,007, filed on May 24, 2006.

(51) Int. Cl.
*F41A 21/48* (2006.01)

(52) U.S. Cl. ..... 42/75.02; 42/90; 42/75.01

(58) Field of Classification Search ..... 42/90, 42/75.01, 75.02
See application file for complete search history.

(56) References Cited

U.S. PATENT DOCUMENTS

| | | | | |
|---|---|---|---|---|
| 3,090,150 | A | 5/1963 | Stoner | |
| 4,571,870 | A * | 2/1986 | Heideman et al. | 42/1.01 |
| 4,756,111 | A * | 7/1988 | Lapier | 42/75.01 |
| 5,020,260 | A * | 6/1991 | Houghton | 42/75.02 |
| 5,198,600 | A * | 3/1993 | E'Nama | 42/90 |
| 5,343,650 | A | 9/1994 | Swan | |
| 5,590,484 | A | 1/1997 | Mooney et al. | |
| 5,826,363 | A | 10/1998 | Olson | |
| 6,269,577 | B1 * | 8/2001 | Hardy | 42/90 |
| 6,293,040 | B1 * | 9/2001 | Luth | 42/75.01 |
| 6,490,822 | B1 | 12/2002 | Swan | |
| 6,499,245 | B1 | 12/2002 | Swan | |
| 6,508,027 | B1 * | 1/2003 | Kim | 42/124 |
| 6,618,976 | B1 * | 9/2003 | Swan | 42/114 |
| 6,671,990 | B1 * | 1/2004 | Booth | 42/75.01 |
| 6,694,660 | B1 | 2/2004 | Davies | |
| 6,725,594 | B2 | 4/2004 | Hines | |
| 6,779,288 | B1 | 8/2004 | Kim | |
| 6,792,711 | B2 | 9/2004 | Battaglia | |
| 6,854,206 | B2 * | 2/2005 | Oz | 42/124 |
| 6,895,708 | B2 * | 5/2005 | Kim et al. | 42/72 |

(Continued)

*Primary Examiner*—Michael Carone
*Assistant Examiner*—Jonathan C Weber
(74) *Attorney, Agent, or Firm*—Sutherland Asbill & Brennan LLP

(57) ABSTRACT

A system for providing a hand guard and accessory mounting device for a firearm can include at least one barrel nut, at least one bolt up plate, at least one hand guard, and at least one mounting device. The at least one barrel nut can be adapted to mount to a portion of a barrel associated with a firearm. The at least one bolt up plate can be adapted to mount between the at least one barrel nut and a portion of the firearm. The at least one hand guard can be adapted to mount to a portion of the bolt up plate, substantially concentric with a portion of the barrel. The at least one mounting device can be adapted to mount to the at least one hand guard, the mounting device being further adapted to receive at least one firearm accessory.

17 Claims, 5 Drawing Sheets

U.S. PATENT DOCUMENTS 6,959,509 B2 * 11/2005 Vais ..... 42/75.02
6,971,202 B2 * 12/2005 Bender ..... 42/16
7,059,076 B2 6/2006 Stoner et al.
RE39,465 E 1/2007 Swan
7,216,451 B1 5/2007 Troy
2003/0226305 A1 * 12/2003 Burnett ..... 42/90
2003/0230022 A1 * 12/2003 Battaglia ..... 42/111
2004/0049964 A1 * 3/2004 Vais ..... 42/75.02
2007/0017139 A1 * 1/2007 Larue ..... 42/75.1
2007/0033851 A1 * 2/2007 Hochstrate et al. ..... 42/75.01
2007/0261285 A1 * 11/2007 Troy ..... 42/75.03

* cited by examiner

SYSTEMS AND METHODS FOR PROVIDING A HAND GUARD AND ACCESSORY MOUNTING DEVICE FOR A FIREARM

RELATED APPLICATION

This application claims priority to U.S. Ser. No. 60/808,007, entitled "Systems and Methods for Providing a Hand Guard and Accessory Mounting Device for a Firearm"," filed May 24, 2006, the contents of which are hereby incorporated by reference.

FIELD OF THE INVENTION

The invention relates generally to the field of firearms, and more particularly, relates to systems and methods for providing a hand guard and accessory mounting device for a firearm.

BACKGROUND OF THE INVENTION

Conventional hand guards for firearms are relatively simple and may adversely affect a user's accuracy when aiming or using the firearm. Conventional hand guards for firearms can protect the user from injuries related to firing the firearm, such as burn or scald injuries caused by relatively high temperatures generated, particularly along the firearm barrel, when using the firearm. Some hand guards can provide a user with an improved grip on the firearm. Although conventional hand guards can protect a user's hands from injury and may provide a gripping surface for a user of the firearm, the torque on the firearm caused by a user's grip on a conventional hand guard can adversely affect the aim and accuracy of the firearm.

One conventional hand guard for a firearm uses a special U-shaped yoke to engage an upper hand guard piece mounted adjacent to a barrel of a firearm. Multiple hand guard pieces can then be supported from the upper hand guard piece to provide protection for a user. Since the special U-shaped yoke can only engage a portion of the barrel nut, because of the U-shape design of the yoke itself, this design and configuration of components may not provide suitable support for the hand guard pieces which will be supported from the yoke and barrel nut combination. In these instances, this conventional hand guard may not suitably protect or aid a user of the firearm.

Therefore, a need exists for systems and methods for providing a hand guard and accessory attachment device for a firearm, for example, a rifle.

A further need exists for systems and methods for providing a firearm hand guard capable of mounting an accessory to the firearm.

Additionally, a further need exists for systems and methods for providing a firearm hand guard capable of storing spare parts to aid a user.

SUMMARY OF THE INVENTION

Various embodiments of the invention address some or all of the needs presented above and certain combinations thereof. Embodiments of the invention can include systems and methods for providing a hand guard and accessory mounting device for a firearm. Embodiments of the invention can include systems and methods for providing a hand guard and accessory attachment device for a firearm, for example, a rifle. Other embodiments of the invention can include systems and methods for providing a firearm hand guard capable of mounting an accessory to the firearm. Furthermore, embodiments of the invention can include systems and methods for providing a firearm hand guard capable of storing spare parts to aid a user. Embodiments of the invention can provide a system and method for providing a hand guard and accessory mounting device for a firearm, such as a M-16, AR-15, AR-10, or M4-type rifle. Embodiments of the invention can provide a user, such as a tactical or skilled shooter, with a system and method for providing a hand guard and accessory mounting device for a firearm, which can improve a user's aim and accuracy of the firearm with the associated hand guard.

In one embodiment, a method for providing a hand guard and accessory mounting device for a firearm can be provided. The method can include positioning at least one bolt up plate with respect to a barrel associated with the firearm. The method can also include mounting at least one barrel nut to a portion of a barrel associated with a firearm, wherein the at least one bolt up plate is positioned between the barrel nut and the firearm. In addition, the method can include mounting at least one hand guard to a portion of the bolt up plate, wherein the at least one hand guard is substantially concentric with a portion of the barrel. Furthermore, the method can include mounting at least one mounting device to the at least one hand guard, wherein the at least one hand guard is substantially concentric with a portion of the barrel when a firearm accessory is mounted to the at least one mounting device.

In one aspect of this embodiment, the barrel nut can include a series of threads corresponding to threads associated with a portion of the firearm.

In another aspect of this embodiment, the bolt up plate can include a ring-shaped plate with multiple bolt holes.

In another aspect of this embodiment, the hand guard can include a cylindrically-shaped component with a barrel receiving end capable of mounting to the bolt up plate.

In another aspect of this embodiment, the mounting device can include a rail-shaped component capable of pivoting with respect to the hand guard.

In another aspect of this embodiment, the hand guard is adapted to free float with respect to the barrel associated with the firearm when at least one firearm accessory is mounted to the at least one mounting device.

In another embodiment, a system for providing a hand guard and accessory mounting device for a firearm can be provided. The system can include at least one barrel nut adapted to mount to a portion of a barrel associated with a firearm. In addition, the system can include at least one bolt up plate adapted to mount between the at least one barrel nut and a portion of the firearm. Furthermore, the system can include at least one hand guard adapted to mount to a portion of the bolt up plate, wherein the at least one hand guard is substantially concentric with a portion of the barrel. Moreover, the system can include at least one mounting device adapted to mount to the at least one hand guard, wherein the mounting device is further adapted to receive at least one firearm accessory.

In one aspect of this embodiment, the barrel nut can include a series of threads corresponding to threads associated with a portion of the firearm.

In another aspect of this embodiment, bolt up plate can include a ring-shaped plate with multiple bolt holes.

In another aspect of this embodiment, the hand guard can include a cylindrically-shaped component with a barrel receiving end capable of mounting to the bolt up plate.

In another aspect of this embodiment, the mounting device can include a rail-shaped component capable of pivoting with respect to the hand guard.

In another aspect of this embodiment, the hand guard is adapted to free float with respect to the barrel associated with the firearm when at least one firearm accessory is mounted to the at least one mounting device.

In another aspect of this embodiment, the at least one mounting device can mount to the at least one hand guard via a plurality of quick disconnect thumb screws.

In another embodiment, an apparatus for a firearm can be provided. The apparatus can include at least one barrel nut adapted to mount to a portion of a barrel associated with a firearm. The apparatus can also include at least one bolt up plate adapted to mount between the at least one barrel nut and a portion of the firearm. Furthermore, the apparatus can include a hand guard adapted to mount to a portion of the bolt up plate, wherein the at least one hand guard is substantially concentric with a portion of the barrel.

In one aspect of this embodiment, the barrel nut can include a series of threads corresponding to threads associated with a portion of the firearm.

In another aspect of this embodiment, the bolt up plate can include a ring-shaped plate with multiple bolt holes.

In another aspect of this embodiment, the hand guard can include a cylindrically-shaped component with a barrel receiving end capable of mounting to the bolt up plate.

In another aspect of this embodiment, the at least one mounting device can be adapted to mount to the at least one hand guard, wherein the mounting device is further adapted to receive at least one firearm accessory.

In another aspect of this embodiment, the mounting device can include a rail-shaped component capable of pivoting with respect to the hand guard.

In another aspect of this embodiment, the hand guard is adapted to free float with respect to the barrel associated with the firearm when at least one firearm accessory is mounted to the at least one mounting device Other embodiments and aspects of the invention will become apparent from the following description taken in conjunction with the following drawings.

DETAILED DESCRIPTION OF EMBODIMENTS

Figure 1:
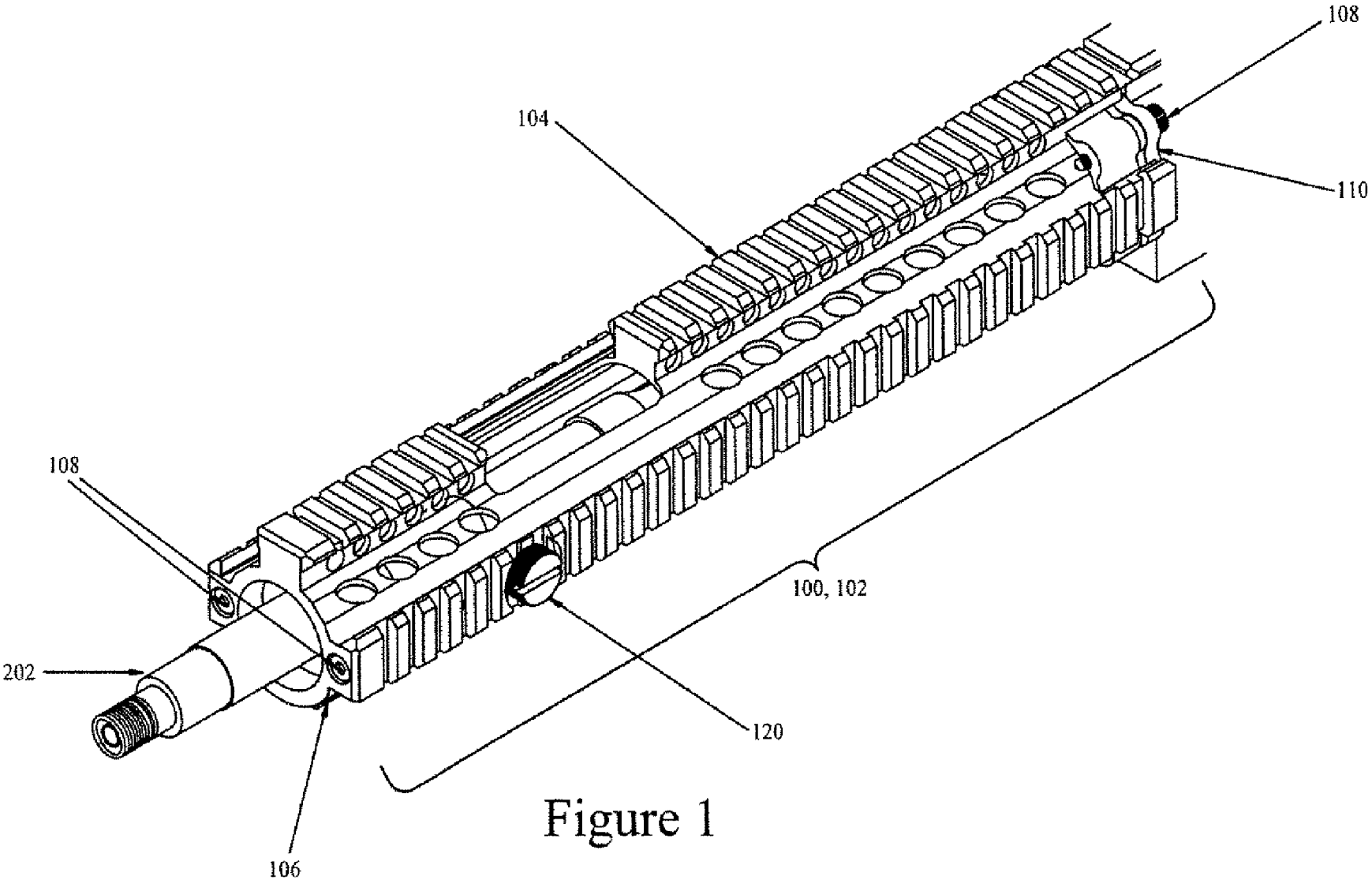
FIG. 1 is a perspective assembly view of an example system and apparatus for providing a hand guard for a firearm in accordance with an embodiment of the invention.
Figure 2:
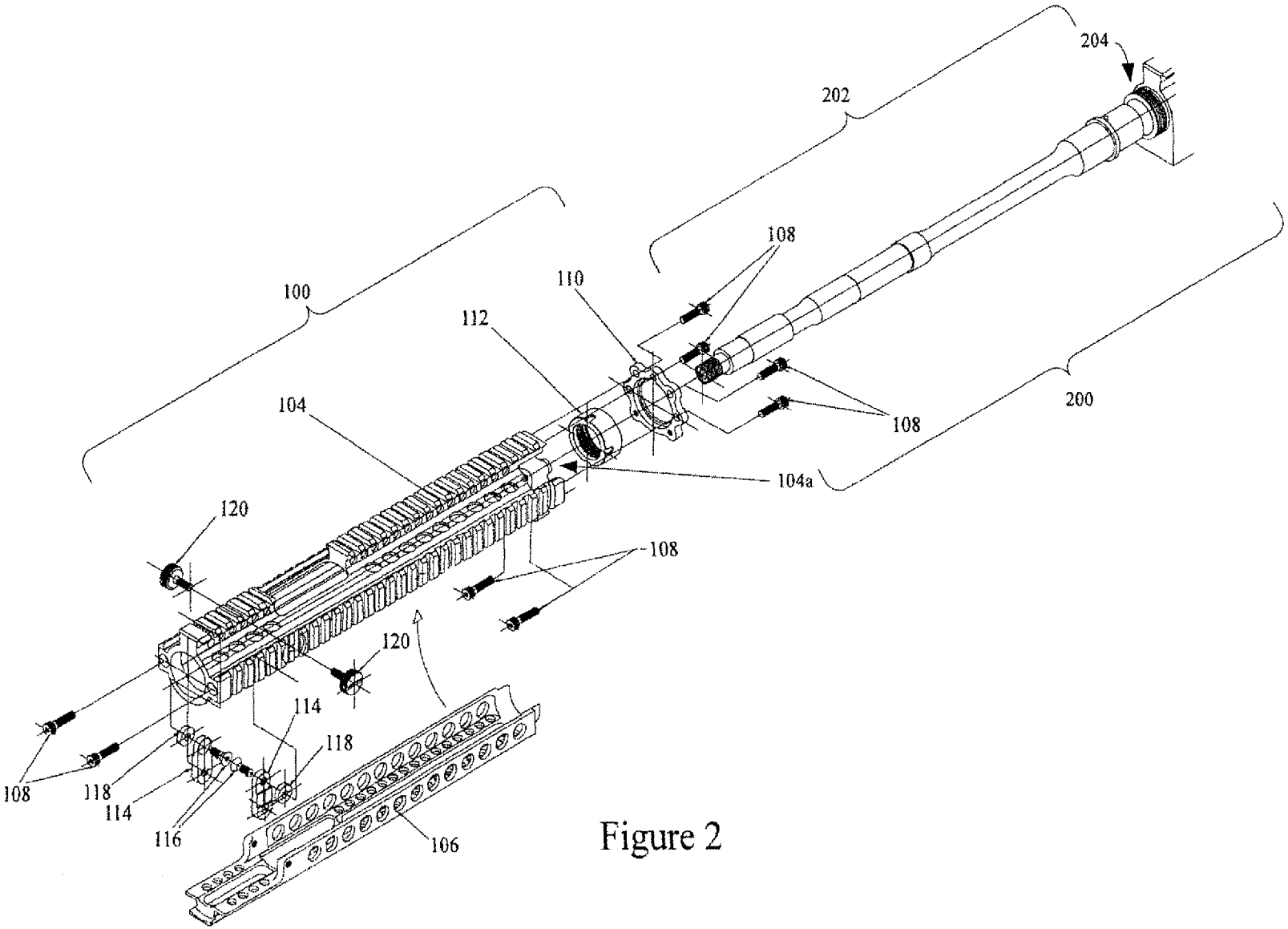
FIG. 2 is an exploded, perspective view of the example system an apparatus embodiment shown in FIG. 1, and apart from the barrel of a firearm.

FIGS. 1 and 2 illustrate respective assembled and disassembled views of an example hand guard and accessory mounting device for a firearm in accordance with an embodiment of the invention. FIG. 1 is a perspective view of an assembled system 100 for providing a hand guard and accessory mounting device for a firearm. FIG. 2 is an exploded, perspective disassembled view of the system 100 shown in FIG. 1. As shown in FIGS. 1 and 2, the system 100 can include a hand guard 102 with an upper rail assembly 104 or hand guard piece, a lower rail assembly 106 or accessory mounting device, a series of bolt up screws 108, a bolt up plate 110 or adaptor, and a barrel nut 112. As described in greater detail below, the upper rail assembly 104 or hand guard piece can mount over a portion of a firearm 200, such as an associated barrel 202 of the firearm 200. Example firearms which can be implemented with embodiments of the invention can be, but are not limited to, M-16, AR-15, AR-10 and M-4 type rifles. The lower rail assembly 106 or accessory mounting device can mount to the upper rail assembly 104 adjacent to a lower portion of the barrel 202. Various embodiments of the invention can incorporate at least one mounting component that can permit a hand guard to circumferentially or concentrically mount around some or all of a portion of the barrel of a firearm.

In the example shown in FIGS. 1 and 2, a system 100 can include a hand guard 102 with an upper rail assembly 104 or a hand guard piece, and a lower rail assembly 106 or an accessory mounting device. The upper rail assembly 104 or hand guard piece is, for example, a cylindrically-shaped piece with a barrel receiving end 104*a*. The central portion of the upper rail assembly 104 is relatively open and hollow to circumferentially or concentrically fit around some or all of the barrel 202 of an associated firearm 200. The barrel receiving end 104*a* can be configured to mount to a portion of a firearm 200. Other embodiments of an upper rail assembly or hand guard piece can have alternative configurations, such as a two or more intersecting pieces, in accordance with other embodiments of the invention.

The lower rail assembly 106 or accessory mounting device is, for example, a rail shaped piece capable of mounting to a portion of the upper rail assembly 104 or hand guard piece. The lower rail assembly 106 is described in greater detail below. Other embodiments of a lower rail assembly or accessory mounting device can have alternative configurations in accordance with other embodiments of the invention.

The bolt up screws 108, bolt up plate 110 or adapter, and barrel nut 112 can be utilized to mount the barrel receiving end 104*a* of the upper rail assembly 104 to a portion of the firearm 200. In the example shown, the firearm 200 can include a barrel 202 with threads 204 corresponding with threads associated with the barrel nut 112. The bolt up plate 110 can mount over a portion of the barrel 202 to engage the corresponding threads 204, and the barrel nut 112 can be rotably mounted to the threads 204 of the firearm 200. In this configuration, the bolt up plate 110 can be aligned to receive the upper rail assembly 104 or hand guard piece.

When the upper rail assembly 104 is aligned to receive the barrel 202 of the firearm 200, a series of bolt up screws 108 or other mounting devices can be inserted through corresponding bolt holes of the bolt up plate 110, and into additional bolt holes in the barrel receiving end 104*a* of the upper rail assembly 104 or hand guard piece. When tightened or otherwise locked, the bolt up screws 108 or other mounting devices can secure the upper rail assembly 104 to the bolt up plate 110. In one embodiment, the barrel nut 112 can be positioned partially between the upper rail assembly 104 and the bolt up plate 110 when the bolt up screws 108 or other mounting devices are secured to the bolt up plate 110. In this manner, the upper rail assembly 104 can be mounted to the firearm 200 via the bolt up plate 110, and the upper rail assembly 104 can provide suitable protection and aid for a user of the firearm.

Embodiments of a hand guard for a firearm can permit the hand guard to "free float" with respect to a barrel of a firearm. In the manner described above, the system 100 allows the hand guard 102 to "free float" with respect to the barrel 202 of the firearm 200. The term "free float" is defined herein as meaning the barrel of a firearm is concentrically aligned within a hollow or partially hollow member (such as a hand guard or upper rail assembly) such that a relatively close space or clearance between the exterior surface of the barrel and interior surface of the hollow member exists along some or all of the barrel around which the hollow member is positioned. When the barrel, such as 202, of the firearm, such as 200, is able to free float with respect to the hand guard, such as 102, some or all movement from a user of the firearm 200, such as the torque on the firearm 200 caused by a user's grip on the hand guard 104, can have a relatively less detrimental effect on the user's aim and accuracy of the firearm 200.

In one embodiment as shown in FIG. 2, various rail-type assemblies and/or rail-mounted accessories, such as a lower rail assembly 106 or an accessory mounting device, can be mounted to a hand guard 102, or upper rail assembly 104 mounted to the hand guard 102, in accordance with an embodiment of the invention. In these embodiments, the barrel 202 of the firearm 200 can still free float with respect to the hand guard 102. In one example, a firearm accessory, such as a M203 Grenade Launcher, can be mounted to the upper rail assembly 104 and the barrel 202 of the firearm 200 can still free float with respect to the hand guard 102. Likewise, one or more suitable rail-mounted firearm accessories can be mounted to a lower rail assembly 106 or assembly mounting device shown in FIG. 2, and the barrel 202 of the firearm 200 can still free float with respect to the hand guard 102, in accordance with an embodiment of the invention.

Figure 3:
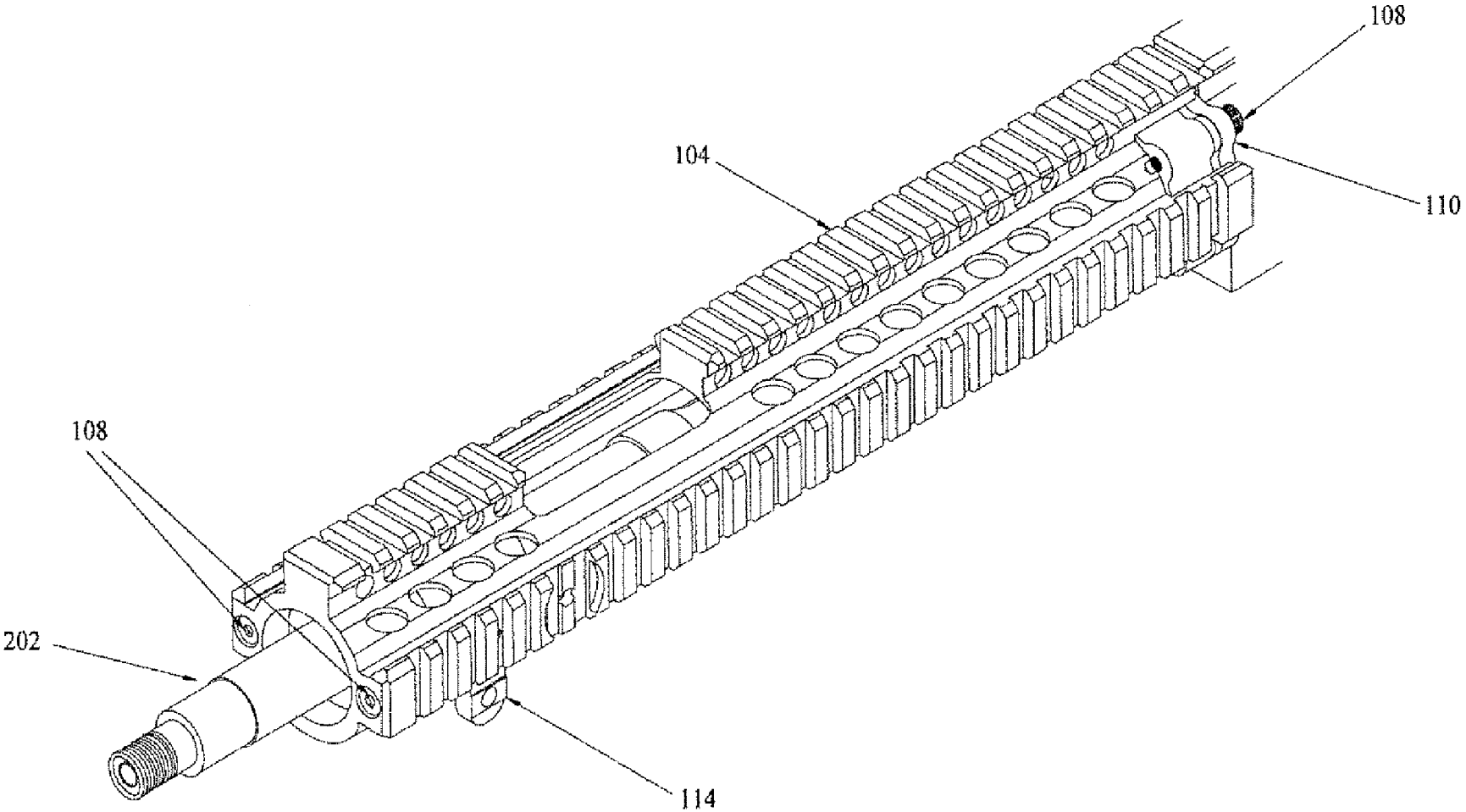
FIG. 3 is a perspective view of example hangers, such as a M203-type hanger, for a firearm in an extended or deployed position, in accordance with an embodiment of the invention.
Figure 4:
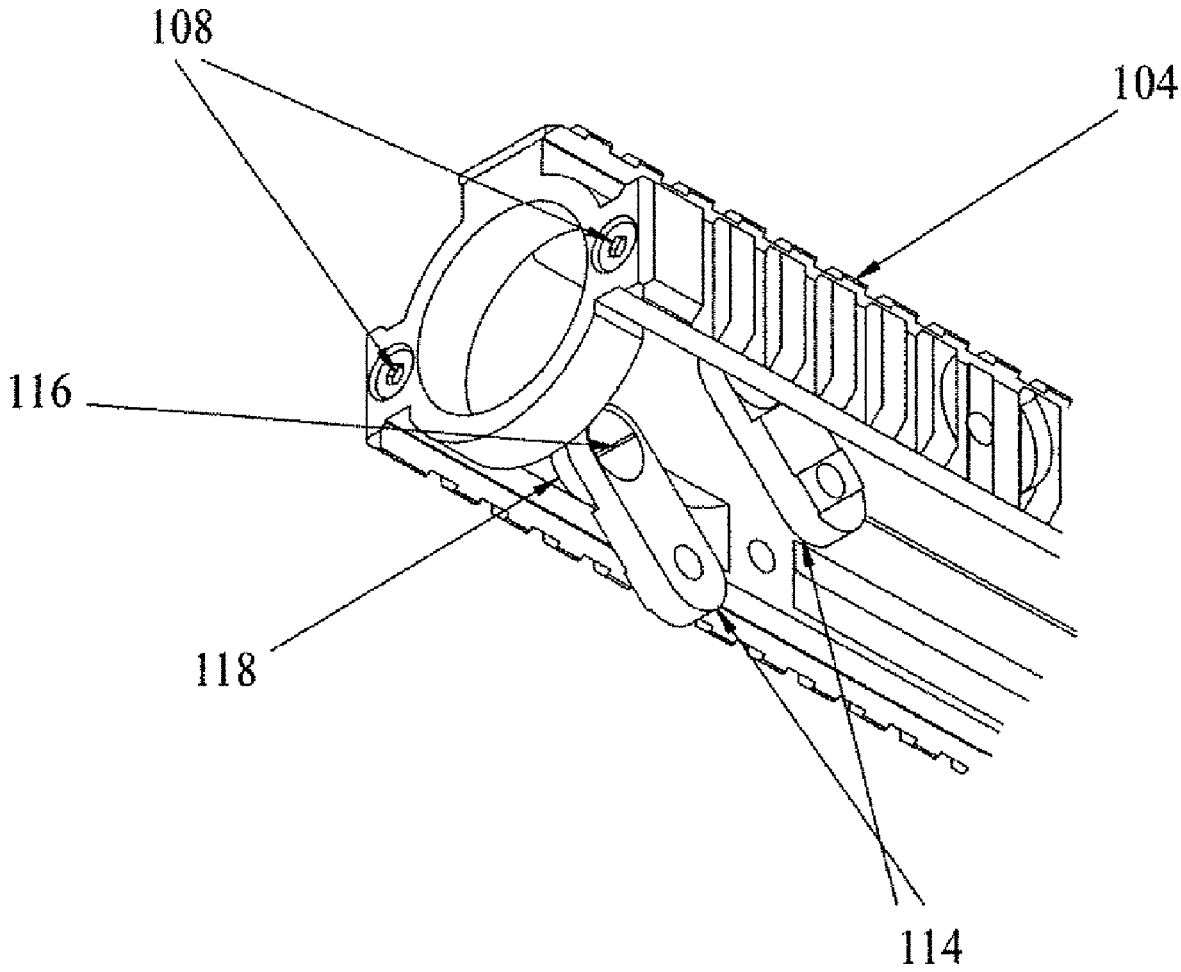
FIG. 4 is another perspective view of example hangers, such as a M203-type hanger, for a firearm in a position between extended or deployed and a closed or stored position, in accordance with an embodiment of the invention.
Figure 5:
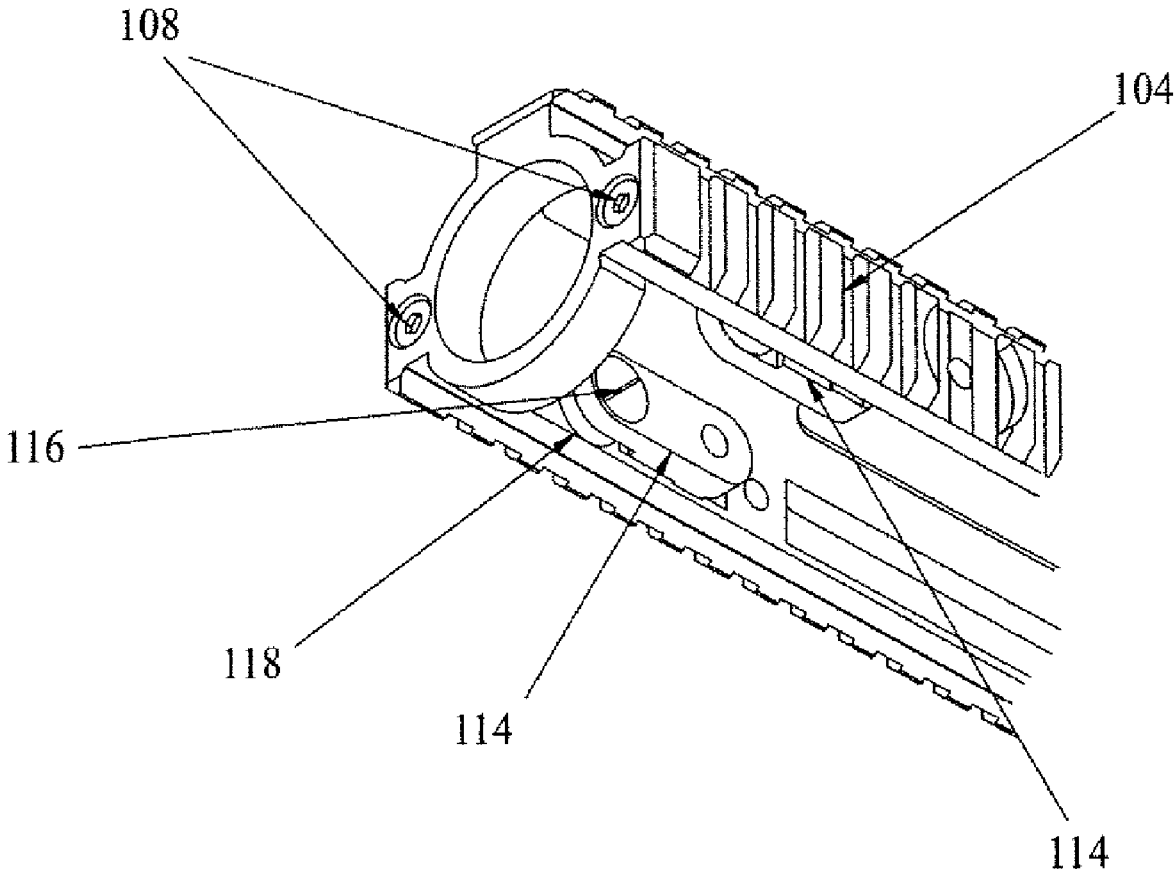
FIG. 5 is another perspective view of example hangers, such as a M203-type hanger, for a firearm in a closed or stored position, in accordance with an embodiment of the invention.

The lower rail assembly 106 or accessory mounting device is generally rail shaped and can include a series of mounting holes or other devices along the length of the assembly 106. The lower rail assembly 106 is capable of mounting to a portion of the upper rail assembly 104 or hand guard piece. As shown in FIGS. 3, 4 and 5, various mounting-type devices, such as hangers 114 or M203-type hangers, can mount to a lower portion of the upper rail assembly 104 via a series of hanger screws 116 or similar devices. Each of the hanger screws 116 can be inserted into corresponding holes in the hangers 114 and can also be mounted with an associated washer 118, such as a nylon-type washer, on an opposing side of the hangers 114. Once the hangers 114 are mounted to the upper rail assembly 104, a firearm accessory such as a M-203-type grenade launcher, for example, can mount to a portion of the extended hangers 114 or a portion of another firearm accessory mounting device. In this manner, a firearm accessory such as a M203-type grenade launcher, can extend from the upper rail assembly 104 shown in FIGS. 4 and 5, or from another accessory mounting device.

In one embodiment, a series of quick disconnect (QD)-type thumbscrews 120 or other screws or fastening devices can be inserted into a series of corresponding holes in the lateral sides of the upper rail assembly 104 as shown in FIGS. 1 and 2. When in use, the lower rail assembly 106 can mount adjacent to the upper rail assembly 104 and the QD thumbscrews 120 or other screws or fastening devices can retain the position of the lower rail assembly 106 adjacent to the upper rail assembly 104 to maintain the lower rail assembly 106 in a position substantially parallel with and in close proximity to the upper rail assembly 104.

In the event the QD thumbscrews 120 or other screws or fastening devices become dislodged or lost, the upper rail assembly 104 can include spare screws or other fastening devices to be substituted for any missing QD thumbscrews 120. These spare screws or other fastening devices can be stored in an associated storage area, compartment, or other indentation within the upper rail assembly 104.

Some or all aspects of the embodiments shown in FIGS. 1-5 can be provided by a "AR15 Lite Rail," "AR10 Lite Rail," as well as a "Rail Interface System (RIS) II," available from Daniel Defense, Inc. of Savannah, Ga. Suitable materials used for the upper rail assembly 104 and lower rail assembly 106 can be, but is not limited to, metals and/or composites. Other materials can be used in accordance with other embodiments of the invention.

While the above description contains many specifics, these specifics should not be construed as limitations on the scope of the invention, but merely as exemplifications of the disclosed embodiments. One skilled in the art will recognize other configurations, shapes, and designs for a system can exist in accordance with other embodiments of the invention. It will be recognized by those skilled in the art that changes may be made in the above described embodiments of the invention without departing from the concepts thereof. The invention is not limited to the particular embodiments disclosed, but is intended to cover all modifications that are within the scope of the invention.

The claimed invention is:

1. A method of providing a hand guard and accessory mounting device for a firearm, the firearm comprising an attachment portion, the attachment portion including threads, the method comprising:

positioning at least one bolt up plate about the attachment portion such that the bolt up plate is immediately adjacent to the threads of the attachment portion and completely encircles the attachment portion;

mounting at least one barrel nut to the attachment portion of the firearm such that the bolt up plate becomes captured between the barrel nut and the firearm;

mounting at least one hand guard to a portion of the bolt up plate, wherein the at least one hand guard is substantially concentric with a portion of the barrel; and mounting at least one mounting device to the at least one hand guard, wherein the at least one hand guard is substantially concentric with a portion of to barrel when a firearm accessory is mounted to the at least one mounting device.

2. The method of claim 1, wherein the bolt up plate comprises a ring-shaped plate with multiple bolt holes.

3. The method of claim 1, wherein the hand guard comprises a cylindrically-shaped component with a barrel receiving end capable of mounting to the bolt up plate.

4. The method of claim 1, wherein the mounting device comprises a rail-shaped component capable of pivoting with respect to the hand guard.

5. The method of claim 1, wherein the hand guard is adapted to free float with respect to the barrel associated with the firearm when the firearm accessory is mounted to the at least one mounting device.

6. A hand guard and accessory mounting device for a firearm, the firearm comprising a barrel and an attachment portion, the attachment portion comprising threads, the device comprising:

a barrel nut adapted to mount the barrel to the attachment portion of the firearm;

a bolt up plate sized and shaped to mount concentrically about the attachment portion of the firearm immediately adjacent to the threads such that when the barrel nut is mounted to the attachment portion, the bolt up plate completely encircles the attachment portion and is captured between the barrel nut and the firearm;

at least one hand guard adapted to mount to a portion of the bolt up plate, wherein the at least one hand guard is substantially concentric with a portion of the barrel; and at least one mounting device adapted to mount to the at least one hand guard, wherein the mounting device is further adapted to receive at least one firearm accessory.

7. The system of claim 6, wherein the bolt up plate comprises a ring-shaped plate with multiple bolt holes.

8. The system of claim 6, wherein the hand guard comprises a cylindrically-shaped component with a barrel receiving end capable of mounting to the bolt up plate.

9. The system of claim 6, wherein the mounting device comprises a rail-shaped component capable of pivoting with respect to the hand guard.

10. The system of claim 6, wherein the hand guard is adapted to free float with respect to the barrel associated with the firearm when the at least one firearm accessory is mounted to the at least one mounting device.

11. The system of claim 6, wherein the mounting device can mount to the at least one hand guard via a plurality of quick disconnect thumb screws.

12. An apparatus for a firearm, the firearm comprising a barrel and an attachment portion, the attachment portion comprising threads, the apparatus comprising:

a barrel nut adapted to mount to the barrel to the attachment portion of the firearm;

a bolt up plate sized and shaped to mount concentrically about the attachment portion of the firearm immediately adjacent to the threads such that when the barrel nut is mounted to the attachment portion, the bolt up plate completely encircles the attachment portion and is captured between the barrel nut and the firearm; and at least one hand guard adapted to mount to a portion of the bolt up plate, wherein the at least one hand guard is substantially concentric with a portion of the barrel.

13. The apparatus of claim 12, wherein the bolt up plate comprises a ring-shaped plate with multiple bolt holes.

14. The apparatus of claim 12, wherein the hand guard comprises a cylindrically-shaped component with a barrel receiving end capable of mounting to the bolt up plate.

15. The apparatus of claim 12, further comprising:

at least one mounting device adapted to mount to the at least one hand guard, wherein the mounting device is further adapted to receive at least one firearm accessory.

16. The apparatus of claim 15, wherein the mounting device comprises a rail-shaped component capable of pivoting with respect to the hand guard.

17. The apparatus of claim 15, wherein the hand guard is adapted to free float with respect to the barrel associated with the firearm when at least one firearm accessory is mounted to the at least one mounting device.

* * * * *